US009790686B1

(12) United States Patent
Samuels et al.

(10) Patent No.: US 9,790,686 B1
(45) Date of Patent: Oct. 17, 2017

(54) TRIANGULAR STUD SHAFT WALL SYSTEM

(71) Applicant: UNITED STATES GYPSUM COMPANY, Chicago, IL (US)

(72) Inventors: Matthew D. Samuels, Arlington Heights, IL (US); Nestor Sanchez, Highland Park, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/233,505

(22) Filed: Aug. 10, 2016

(51) Int. Cl.

| | |
|---|---|
| ***E04C 3/02*** | (2006.01) |
| ***E04B 2/60*** | (2006.01) |
| ***E04C 3/30*** | (2006.01) |
| *E04C 3/04* | (2006.01) |

(52) U.S. Cl.
CPC ..... *E04C 3/02* (2013.01); *E04B 2/60* (2013.01); *E04C 3/30* (2013.01); *E04C 2003/0469* (2013.01)

(58) Field of Classification Search
CPC ..... E04C 2003/0469; E04C 3/02; E04C 3/30; E04C 3/32; E04B 2/60
See application file for complete search history.

(56) References Cited

U.S. PATENT DOCUMENTS 1,360,720 A * 11/1920 Brown ..... B64C 1/065 52/838
3,397,500 A * 8/1968 Watson, Jr. ..... E04B 2/60 52/282.1
4,048,777 A * 9/1977 Carroll ..... E04B 2/60 52/309.12
4,507,901 A * 4/1985 Carroll ..... E04L 37/00 52/220.1
5,279,091 A * 1/1994 Williams ..... E04B 2/7457 52/241
5,499,480 A * 3/1996 Bass ..... E04C 3/07 403/232.1
5,553,437 A * 9/1996 Navon ..... E04C 3/07 52/837
5,664,388 A * 9/1997 Chapman ..... E04C 3/065 52/262
5,875,603 A * 3/1999 Rudd ..... E04C 3/292 52/376
6,629,392 B1 10/2003 Harrel et al.
(Continued)

OTHER PUBLICATIONS

Gypsum Wallboard, Steel Studs, GA File No. WP7125, Gypsum Association Design, 1970.
(Continued)

*Primary Examiner* — Andrew J Triggs
(74) *Attorney, Agent, or Firm* — Vorys, Sater, Seymour and Pease LLP; Pradip Sahu; Philip T. Petti

(57) ABSTRACT

A shaft wall assembly system including triangular shaped steel studs with one or more layers of wall board secured to one side of the triangular shaped steel studs. The triangular steel studs preferably rest in a notched floor runner and a notched ceiling runner. The one or more layers of wall board are then directly attached to a flat side of the triangular stud with properly sized steel screws. This system will be useful as a shaft wall system or in locations where attachment of wall board to both sides of a wall system is not feasible.

14 Claims, 10 Drawing Sheets

(56) References Cited

U.S. PATENT DOCUMENTS

| | | | | |
|---|---|---|---|---|
| 6,708,459 | B2 * | 3/2004 | Bodnar | E04C 2/384 52/335 |
| 7,712,267 | B2 | 5/2010 | Lehane et al. | |
| 8,424,266 | B2 | 4/2013 | Edmondson | |
| 8,863,477 | B2 * | 10/2014 | Stal | E04B 1/24 264/279 |
| 2001/0017016 | A1 * | 8/2001 | Rudduck | E04C 3/065 52/481.1 |
| 2005/0229523 | A1 | 10/2005 | Bodnar | |
| 2009/0007520 | A1 * | 1/2009 | Navon | E04B 7/022 52/837 |

OTHER PUBLICATIONS

Important Fire Safety Information 5/8" Type X Gypsum Wallboard Standards, Testing, and Certification, URL: < http://www.ul.com >, retrieved from the Internet Jan. 25, 2016.

Fire Tests of Building Construction and Materials-UL 263, Underwriter Laboratories, Jun. 21, 2011.

Gypsum Panel Products Types, Uses, Sizes, and Standards (GA-223-04), Gypsum Association, 2004.

ProSTUD® product catalog, Clarkwestern Dietrich Building Systems LLC, clarkdietrich.com, Jun. 24, 2015.

ASTM E119-07a, Standard Test Methods for Fire Tests of Building Construction and Materials, ASTM International, West Conshohocken, PA, 2007, www.astm.org.

Deward A. Donoghue, CPCA, ASME A17.1/CSA B44 Handbook, The American Society of Mechanical Engineers, 2013.

* cited by examiner

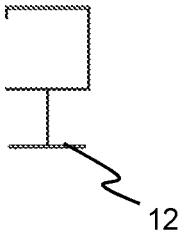
FIG.1 (Prior art)
FIG. 2 (Prior art)
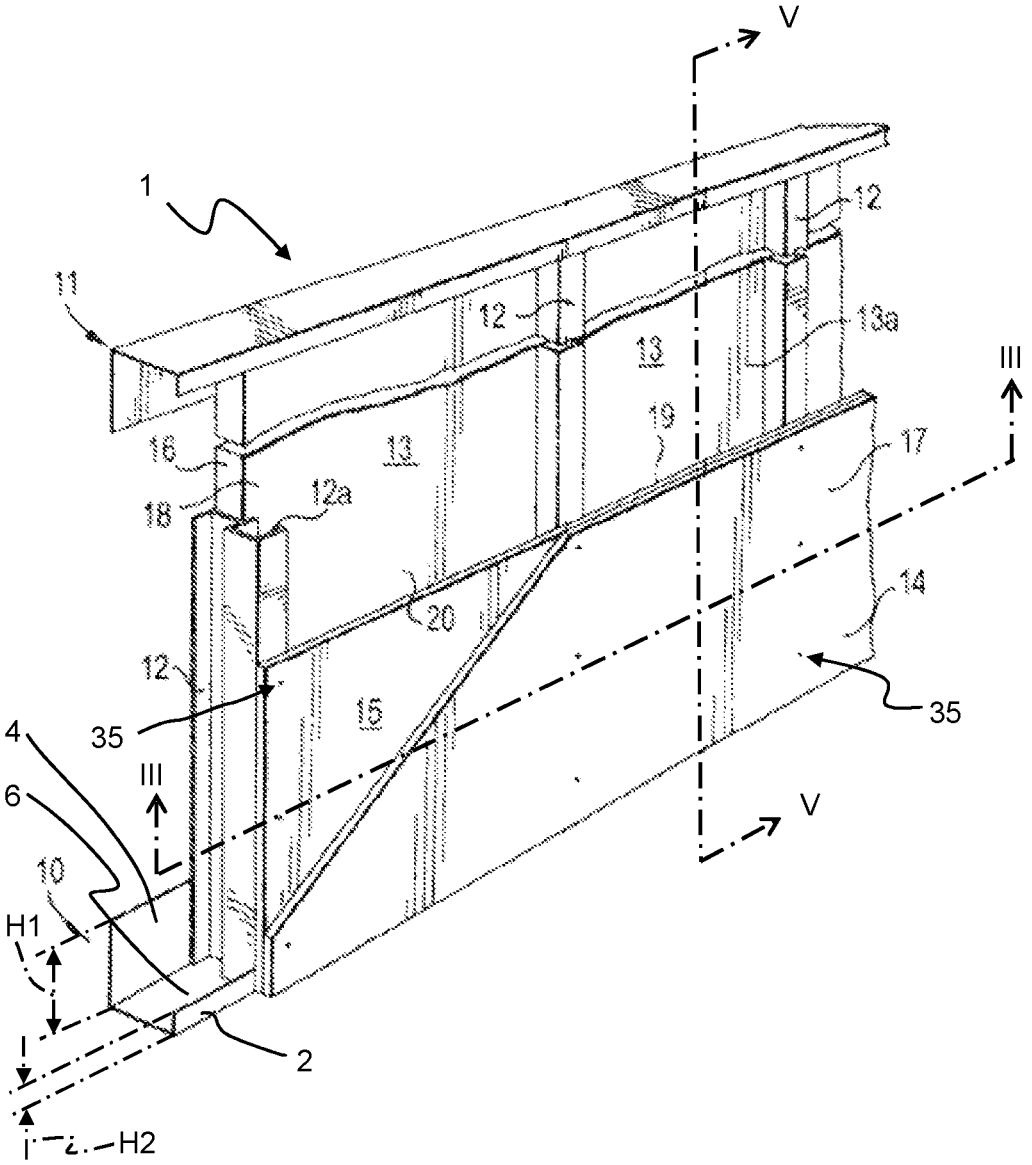

FIG. 12
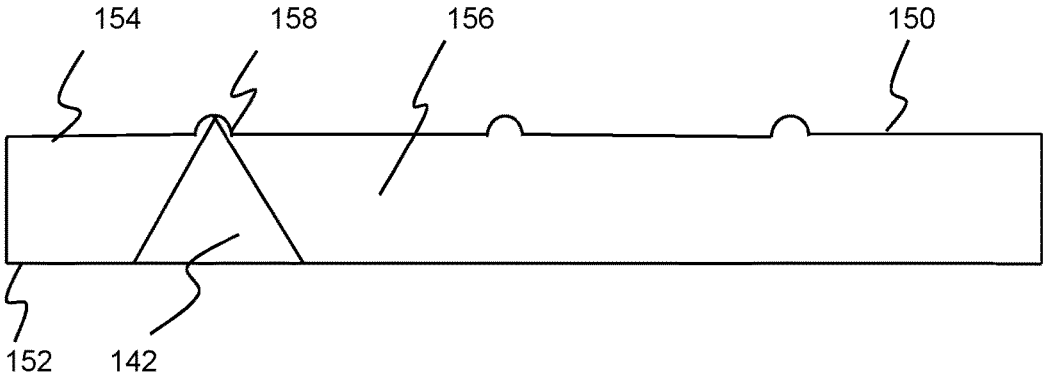
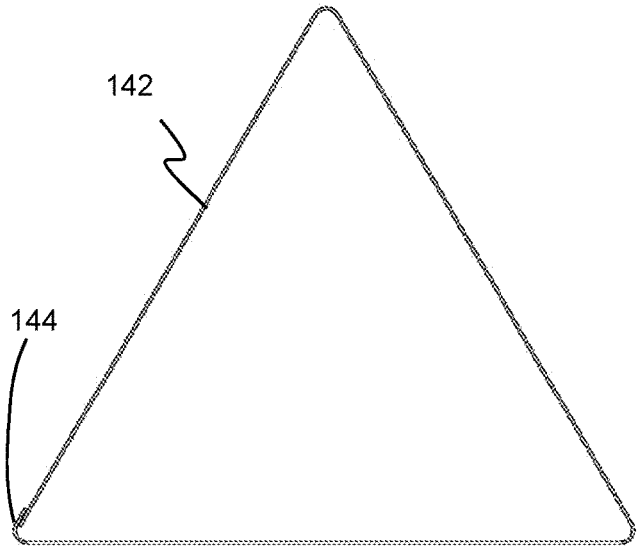
FIG. 10
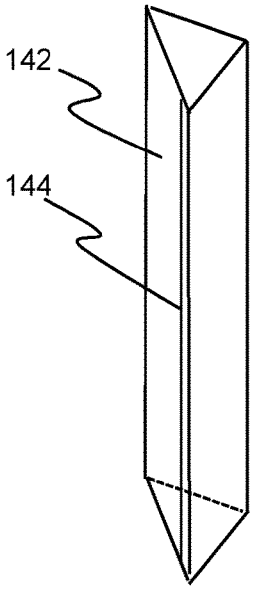
FIG. 11

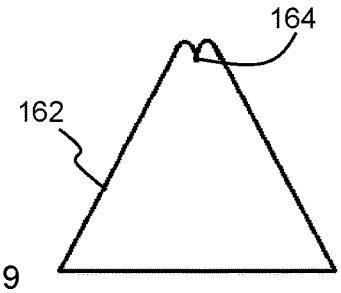
FIG. 19
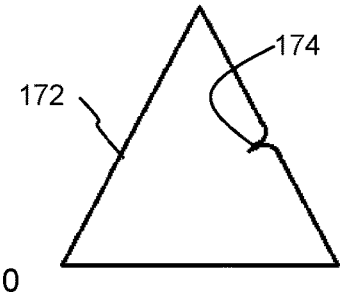
FIG. 20
FIG. 21
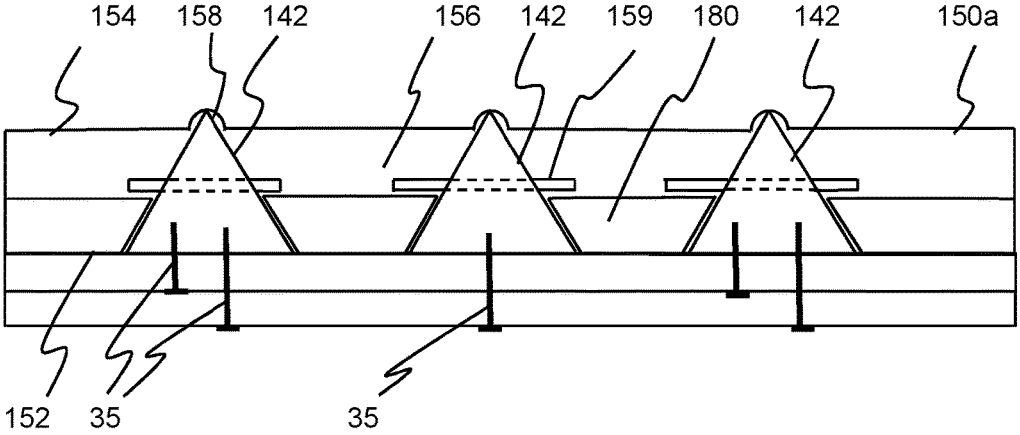
FIG. 22
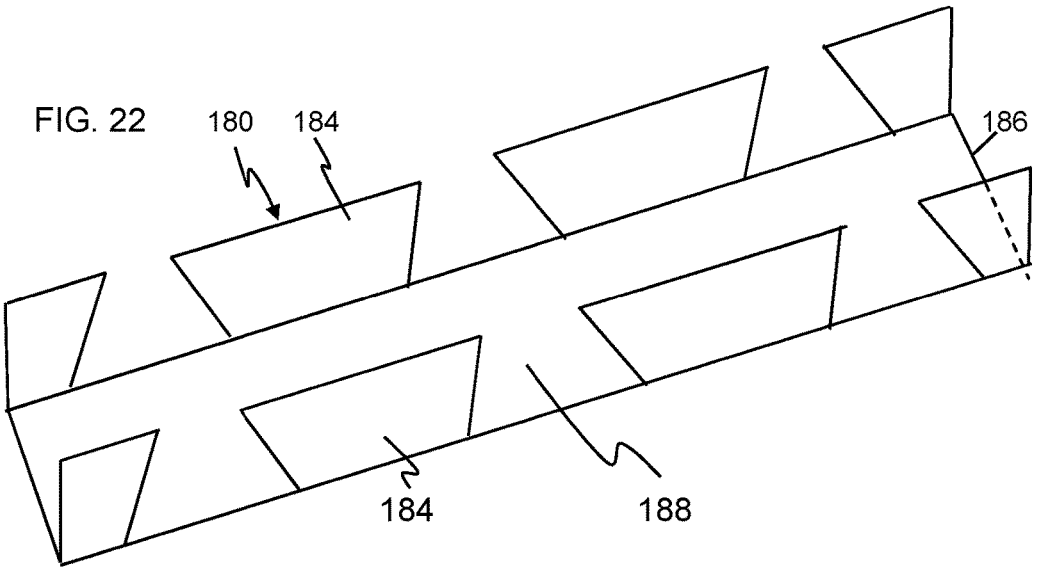

TRIANGULAR STUD SHAFT WALL SYSTEM

BACKGROUND

1. Field of the Invention

The invention relates generally to a shaft wall construction comprising of triangular studs used to hold wall panels in place during construction and service life of shaft walls in buildings. The system includes triangular shaped steel studs with one or more layers of gypsum board secured to one side of the triangular shaped steel studs. The triangular steel studs rest in a notched floor and ceiling runner. The one or more layers of gypsum board are then directly attached to a flat side of the triangular stud with properly sized steel screws. This system will typically be used as a shaft wall system or constructed in locations where attachment of gypsum board to both sides of a wall system is not feasible.

2. Background of the Invention

Walls around shafts, such as elevator shafts, were traditionally formed from concrete. Such installations required personnel working inside the shaft to have to wait until the walls were completed, then remove debris and other material from the concrete erection.

As an improvement to the concrete systems, the assignee of the present invention developed a system whereby drywall (such as SHEETROCK brand gypsum board, available from United States Gypsum Corporation of Chicago, Ill.) or other wall panels can be installed from outside the shaft, thereby significantly reducing any scaffolding, and construction debris inside the shaft. Such present day shaft wall assemblies are constructed from one side only, namely outside the shaft. By installing the wall panels from the outside, personnel working inside the shaft no longer needed to wait until the construction was completed to begin their work.

Such systems typically include a pair of J-runners into which a first wall panel is inserted, with the first J-runner along the top of the wall panel and a second J-runner along the bottom as well as both ends of the wall. The J-runner generally is formed from metals, such as steel, and typically includes a first short upstanding section and a second tall upstanding section in a substantially parallel configuration, each forming a substantially right angle with a middle section. Such a configuration allows for a first wall panel (or shaft panel) to be inserted between the upstanding sections to form the interior of the shaft. Additional wall panels can be affixed to the outside of the J-runners, typically to the outer surfaces of the short upstanding sections to form the interior of the room. In typical shaft wall constructions, wall studs, such as C-H studs and E-studs, are used to hold the wall panel in place. This type of construction is described by U.S. Pat. Nos. 3,943,680; 3,940,899; and 4,152,878, all to Balinski, each of which is hereby incorporated by reference in its entirety.

Shaft walls fasteners are not permitted to penetrate from the outermost wall through the assembly according to Fire Tests of Building Construction and Materials, UL 263, Jun. 21, 2011. ASTM E119-15 also limits fastener penetration in shaft wall assemblies. In other words the fastener, such as a nail or screw, cannot penetrate from the outer wall of the shaft wall assembly to the exposed inner space of the shaft. If fasteners do penetrate the assembly, temperature measurements are required to be measured on the heads of the fasteners.

To avoid fastener penetration into exposed inner space of the shaft a conventional shaft wall assembly employs a C-H stud 10 as shown in FIG. 1. FIG. 2 shows a perspective view of an embodiment of such a shaft wall assembly 1 employing the C-H studs 12 and the first and second J-runners 10, 11 to hold the inner and outer walls in place. The first J-runner 10 and the second J-runner 11 are installed in a substantially parallel relationship as well as right and left ends which are not shown, with multiple C-H studs 12 positioned in a substantially perpendicular relationship between the first J-runner 10 and the second J-runner 11. Each J-runner 10, 11 has a horizontal middle wall (section) 6, a shorter vertical wall 2, and a taller vertical wall 4 (FIG. 2). The middle wall 4 forms a substantially planar transverse plane having opposed first and second longitudinal sides each, having a length, and opposed first and second ends, each having a width, wherein the length of each longitudinal side is greater than the width of each end. The shorter vertical wall 2 has a first height H1 and the taller vertical wall 4 has a second height H2, wherein the first height H1 is less than the second height H2. The shorter vertical wall 2 extends to the first height from the first longitudinal side of the middle wall 6. The taller vertical wall 4 extends to the second height from the second longitudinal side of the middle section. The shorter vertical wall 2 and the taller vertical wall 4 are substantially parallel. The middle wall 6, the shorter vertical wall 2 and the taller vertical wall 4 form a generally J-shape.

Positioned between the first J-runner 10 and the second J-runner 11, and between each of the studs 12 is a single shaft liner panel 13. Each shaft liner panel 13 has opposed vertical edges 16 (one shown) inserted into a respective cavity of a stud 12. FIG. 2 shows one edge 16 inserted into a first stud, while the opposed other edge is hidden within a cavity of a second adjacent stud 12. As seen in FIG. 2, wall stud 12 has an in-turned lip 12*a* and the panel 13 is seated between walls of the stud 12 defining a cavity of the stud 12.

Located outside the J-runners 10 and 11 are a pair of wall boards 14 and 15. When fully installed as an inner surface of the shaft, shaft liner panel 13 forms the inside 28 (FIG. 4) of the shaft, while an outer surface 17 of the wall board 14 forms the interior wall of a room. Additionally, a surface 13*a* of the shaft liner panel 13 and a surface 19 of the wall board 15 define a wall cavity 20. The wall cavity 20 may be filled with insulation, electrical wiring, plumbing, and/or other building components. Fasteners 35 are selected from screws and nails and do not extend from the outer wall board 14 or 15 to the shaft liner panel 13. Wall boards 14. 15 are typically gypsum wallboard panels.

Typical gypsum wallboard panels and liner panels are made of Type X gypsum wallboard or Type C gypsum wallboard. ⅝" Type X gypsum board provides one-hour fire protection when used on both sides of a steel partition.

FIG. 3 is a top view of a portion 30 of shaft wall assembly 1 with the J-runners omitted for clarity. This shows fasteners 35 selected from screws and nails do not extend to inside wall liner panels 13. The C-H stud 12 is employed as part of the shaft wall assembly 1 having the inside wall made of liner panels 13 slid into opposed sides of the H-portion of the C-H stud 12 and a visible outer wall having two layers of wall board panels 15, 14. The shaft wall assembly 1 employs fasteners 35 such as screws or nails to fasten panel 15 and panel 14 to C-H stud 10. FIGS. 2 and 3 show the inner wall liner panels 13 define the inside space 28 of the shaft wall assembly 1, separate wall cavity 20 from the inside space 28 of the shaft wall assembly 1, and prevents direct contact of the fasteners 35 with the inside space 28 of the shaft wall assembly 1.

FIG. 3 only shows one fastener 35 attaching panels 14 and 15 to the C-H stud 12. However, it is apparent from FIG. 2 that some fasteners 35 attach panel 15 to the C-H stud 12 and other fasteners 35 attach both panel 14 and panel 15 to the C-H stud 12.

FIG. 4 shows a modified version 40 of the shaft wall assembly of FIG. 3, wherein the outermost layer of panels 14 is omitted. The inside wall is made of liner panels 13 slid into opposed sides of the H-portion of the C-H stud 12. The visible outside wall is made of one layer of gypsum wallboard panels 15 (one shown) attached to the C portion of the C-H stud 12 by fasteners 35 (one shown) selected from screws or nails. This also shows the fasteners 35 selected from screws and nails do not extend to liner panels 13.

U.S. Pat. No. 7,712,267 to Lehane discloses a modification to the shaft wall assembly of FIG. 2 wherein the first (or lower) J-runner 10 is modified to have one more lifting elements or ledge or both to permit simple centering of studs or shaft walls or both. By providing a lifting member in a lower J-runner, the studs or shaft walls or both can rest upon the lifting member to assist in vertically centering the studs or shaft walls or both when the shaft is fully constructed. Thus, the lifting elements allow for self-centering of the panel 13 between the J-runners 10, 11. FIG. 5 shows an embodiment of a shaft wall assembly employing a J-runner of Lehane having a lifting element 21.

Preferably the lifting elements 21 form a flattened surface (ledge) 22 upon which the studs 12 and/or the shaft liner panel 13 can rest. Generally, shaft liner panel 13 is inserted into the J-runner 10, pushed up the ramping edge 23 until it rests upon the ledge 22 and then slid horizontally until a first vertical edge of the shaft panel 13 is properly seated in a first stud 12. Then the next stud 12 is put into place between the lower J-runner 10 and upper J-runner 11 and pushed against the shaft liner panel 13 to have a second vertical edge of the shaft panel 13 seat in a cavity of the second stud 12. The lifting elements also provide a space 24 to define a drain.

Conventional shaft wall assemblies with C-H studs and panels have many benefits. For example, they are constructed from one side only, fire ratings are applicable from either side, they are proven by years of tests and real world use, and they provide relatively quick construction. However, a disadvantage of conventional shaft wall assemblies with C-H studs and panels is they require liner panels which can be difficult to produce and transport. Also, there is generally a limitation in size and gauge of C-H studs, for example they are employed with 24 inch wide liner panels. It would be beneficial to develop a construction that did not require liner panels.

SUMMARY OF THE INVENTION

To solve the deficiencies of conventional constructions, the shaft wall assembly of the invention is provided with one or more supporting studs having a triangular cross-section. Thus, fasteners, such as screws (for example type S drywall screws) can be screwed into the void space within the triangular stud so they are not exposed to the exposed inner space of a shaft wall assembly. The triangular studs are sized to have a depth to fit into a standard floor runner and ceiling runner. The floor runner may be a J-shaped runner or a C-shaped runner. Also, the ceiling runner may be a J-shaped runner or a C-shaped runner. Preferably, the floor and ceiling runners are C-shaped.

The C-runner which may be employed in the assembly of the invention includes a front upstanding section and a back upstanding section in a parallel configuration, each forming a substantially right angle with a middle section, with optional lifting elements positioned on the middle section and/or upstanding sections. The front upstanding section and the back upstanding section have about the same height.

The J-runner if employed in the assembly of the invention includes a short upstanding section and a tall upstanding section in a parallel configuration, each forming a substantially right angle with a middle section, with optional lifting elements positioned on the middle section and/or upstanding sections.

Regardless of whether the runner is a C-runner or J-runner is employed, if desired a notched runner is employed with notches every 6 to 12 inches on center (OC), typically 8 inches OC to accommodate for multiple stud spacing scenarios. The notch is an indentation or a protrusion on one of the upstanding walls of the runner. One, two, three or even 4 layers of gypsum board are secured to only one side of the triangular studs. The system will be asymmetrical with gypsum board on only one side of the wall and one face of the triangle.

In particular the invention provides a shaft-wall assembly comprising:

a shaft wall having upper, lower, left and right sides;

a floor runner positioned adjacent to the lower side of the shaft wall, a ceiling runner, positioned adjacent to the upper side of the shaft wall, wherein each of the floor runner and the ceiling runner comprises:

a substantially planar transverse middle section having opposed first and second longitudinal sides each having a length and opposed first and second ends each having a width, wherein the length of each longitudinal side is greater than the width of each end;

a first upstanding section and a second upstanding section, wherein the first upstanding section has a first height and the second upstanding section has a second height, the first upstanding section extending to the first height from the first longitudinal side of the middle section, and the second upstanding section extending to the second height from the second longitudinal side of the middle section a triangular stud of the shaft wall between the floor runner and the ceiling runner, the triangular stud having a triangular polyhedron shape comprising three sidewalls defining a triangular bottom perimeter and a triangular top perimeter;

the floor runner and the triangular stud sized for a first said side of the triangular stud to contact the first upstanding section of the floor runner and a vertex of the triangular stud opposed to the first side of the triangular stud to contact the second upstanding section of the floor runner.

If a J-runner as a floor or ceiling runner is employed the first height is less than the second height. If a C-runner is employed as a floor or ceiling runner the first height and the second height are equal.

The invention also provides a triangular stud for a shaft wall, the triangular stud having a triangular polyhedron shape comprising three sidewalls defining a triangular bottom perimeter and a triangular top perimeter, a lower end portion of the triangular stud having a notch for mating with a protrusion of a J-runner.

The invention also provides a runner comprising:

a substantially planar transverse middle section having opposed first and second longitudinal sides each having a length and opposed first and second ends each having a width, wherein the length of each longitudinal side is greater than the width of each end;

a first upstanding section and a second upstanding section, wherein the first upstanding section has a first height and the second upstanding section has a second height, the first upstanding section extending to the first height from the first longitudinal side of the middle section, and the second upstanding section extending to the second height from the second longitudinal side of the middle section, wherein the first upstanding section and the second upstanding section are substantially parallel;

wherein the runner has at least one feature selected from the group consisting of vertically elongated indentations spaced along the first upstanding section and vertically elongated protrusions spaced along the first upstanding section.

If a J-runner is employed as a floor or ceiling runner the first height is less than the second height. If a C-runner is employed as a floor or ceiling runner the first height and the second height are equal.

BRIEF DESCRIPTION OF THE DRAWINGS

FIG. 1 shows a top view of a C-H stud of the prior art.

FIG. 2 is a cut-away perspective view of a first embodiment of a shaft wall assembly of the prior art employing the C-H stud of FIG. 1 in an installed condition.

FIG. 10 shows a top view of an alternative embodiment of the triangular stud without the notches, but having an overlapping corner forming a seam or punch connection.

FIG. 11 shows a perspective view of the alternative embodiment of FIG. 10 having the overlapping corner forming the seam or punch connection.

FIG. 12 is a top view of a J-runner of the invention having protrusions on its higher wall to assist in placing the triangular stud of FIG. 11 in a modified version of the assembly of FIG. 6.

FIG. 19 shows a top view of another alternative embodiment of the triangular stud without the notches, but having a symmetrically overlapping corner forming a seam or punch connection.

FIG. 20 shows a top view of another alternative embodiment of the triangular stud without the notches, but having a side including a symmetrically overlapping section forming a seam or punch connection.

FIG. 21 shows a top view of the embodiment of FIG. 13 further including blocking applied to the face of the studs to add structural stability. When the panels are horizontal one screw may be employed as shown in the center stud, but when the panels are vertical two screws are employed as in the left and right triangular studs.

FIG. 22 shows a perspective view of the blocking of FIG. 21.

In the figures, like numbered elements have the same configurations unless otherwise indicated.

DETAILED DESCRIPTION OF THE PREFERRED EMBODIMENTS

Figure 3:
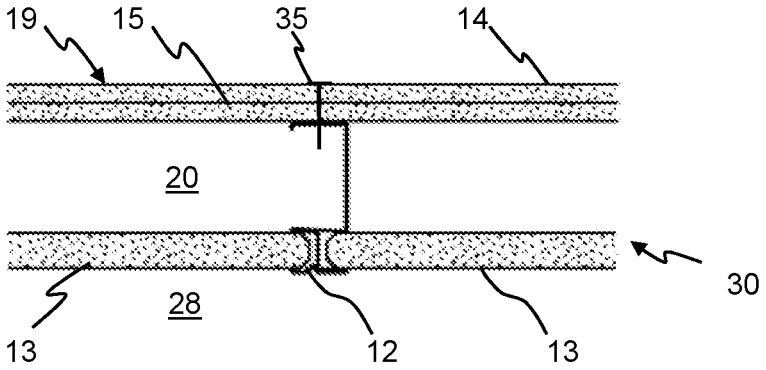
FIG. 3 (Prior art)
FIG. 3 is a cross-sectional top view of a portion of the assembly of FIG. 2 with the J-runners removed for clarity.
Figure 4:
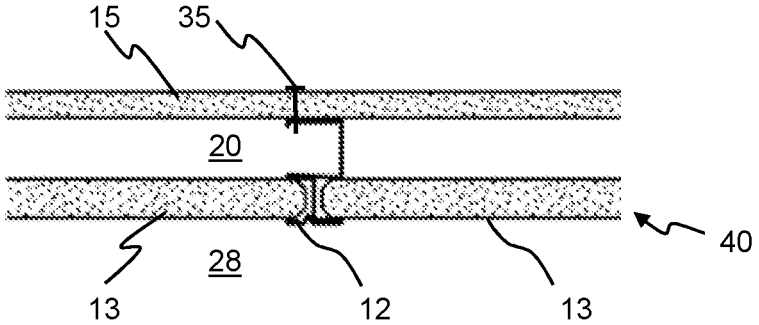
FIG. 4 (Prior art)
FIG. 4 is a cross-sectional top view of a modified version of the assembly of FIG. 3.
Figure 5:
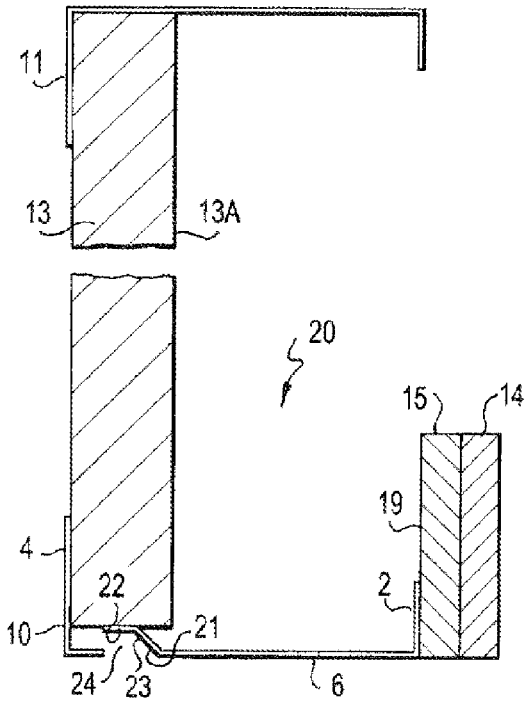
FIG. 5 (Prior art)
FIG. 5 is a cross section of the assembly of FIG. 2 along line V-V modified to add a lifting element.
Figure 6:
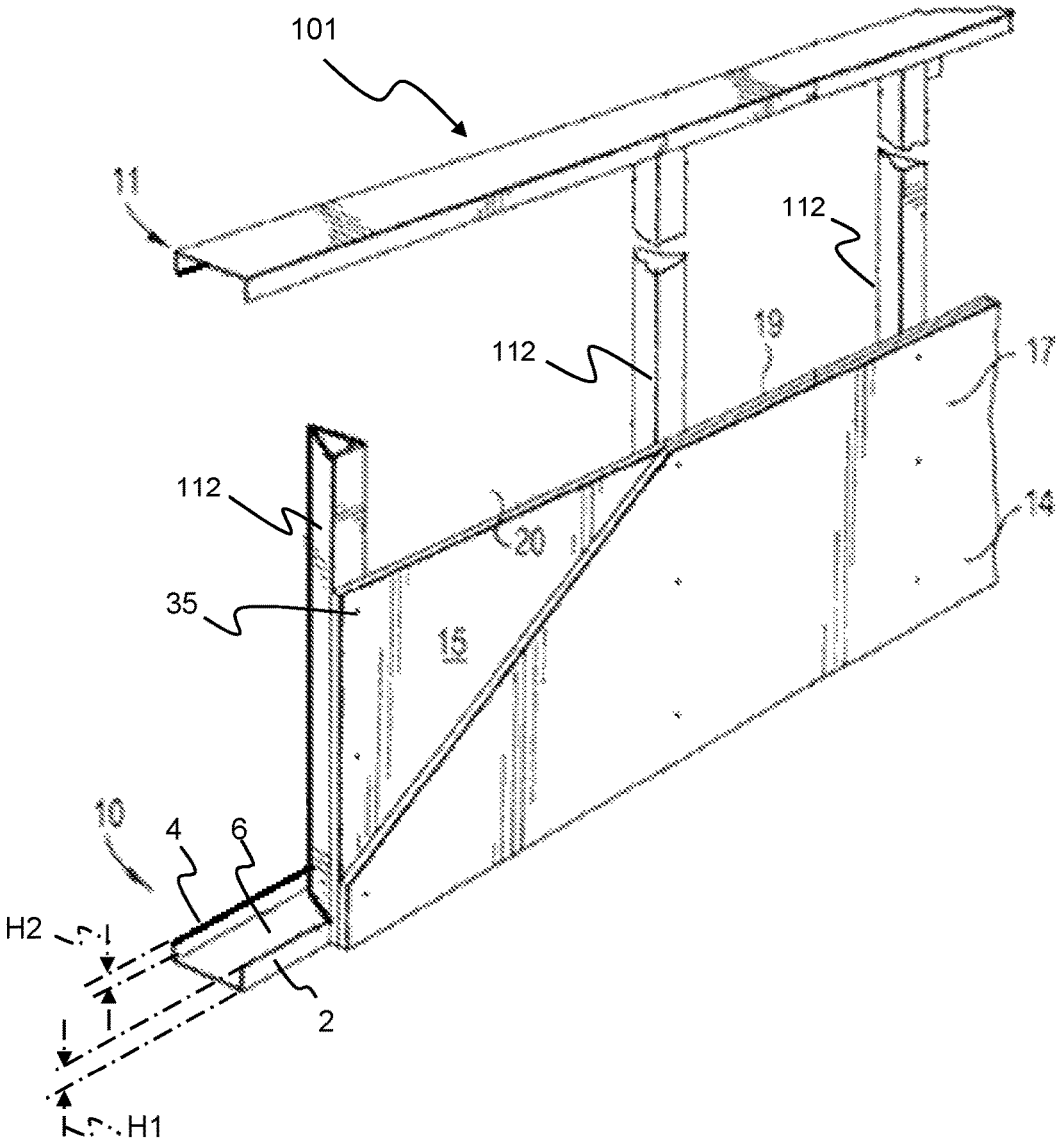
FIG. 6 is a perspective view of a first embodiment of a shaft wall assembly of the present invention employing triangular studs and C-runners and having a portion of a wall cut-away to show details of the embodiment.

With reference to the embodiment of shaft wall 101 of FIG. 6, typically, a floor C-runner 10 and a ceiling C-runner 11 are installed in a substantially parallel relationship, with multiple triangular studs 112 positioned in a substantially perpendicular relationship between the floor C-runner 10 and the ceiling C-runner 11.

The triangular stud 112 of the shaft wall is between the floor C-runner 10 and the ceiling C-runner 11. The triangular stud 112 has a triangular polyhedron shape comprising three sidewalls defining a triangular bottom perimeter and a triangular top perimeter. Preferably, all transverse cross-sections of the triangular stud 112 parallel to the top perimeter and the bottom perimeter are the same triangle.

Each C-runner 10, 11 has a horizontal middle wall (section) 6, a first vertical wall 2, and a second vertical wall 4 (FIG. 6). Height H1 of the first vertical wall 2 and height H2 of the second vertical wall 4 are about the same. The middle wall 6 forms a substantially planar transverse plane having opposed first and second longitudinal sides each, having a length, and opposed first and second ends, each having a width, wherein the length of each longitudinal side is greater than the width of each end. The first vertical wall 2 extends to the first height H1 from the first longitudinal side of the middle wall 6. The second vertical wall 4 extends to the second height H2 from the second longitudinal side of the middle section. The first vertical wall 2 and the second vertical wall 4 are substantially parallel. The middle wall 6, the first vertical wall 2 and the second vertical wall 4 form a generally C-shape.

Unlike the conventional system 1 of FIG. 2, the shaft wall assembly system 101 of the present invention has no shaft liner panel positioned between the floor runner 10 and the ceiling J-runner 11, and between each of the studs 112. Points of the fasteners 35 end within a cavity within the triangular stud so they do not contact the inside space 28 of the shaft wall assembly 1 of the shaft wall assembly 101. There is no need for shaft liner panels to separate the pointed inner ends of the fasteners from the inside space 28 of the shaft wall assembly.

Located outside the C-runners 10 and 11 are a pair of wall boards 14 and 15. When fully installed an inner surface of wall board 15 forms the inside of the shaft, while an outer surface of the wall board 14 forms the interior wall of a room.

Located outside the J-runners 10 and 11 are a pair of wall boards 14 and 15. When fully installed an inner surface of wall board 15 forms the inside of the shaft, while an outer surface of the wall board 14 forms the interior wall of a room.

Figure 6A:
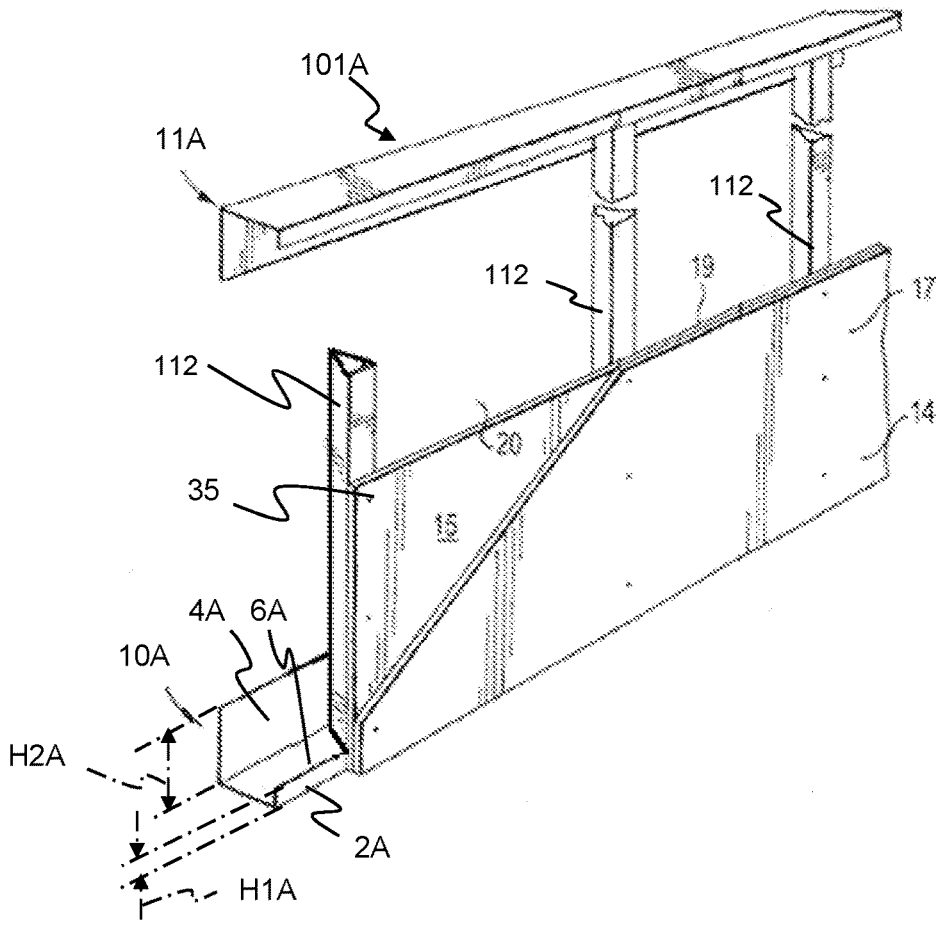
FIG. 6A is a perspective view of a first embodiment of a shaft wall assembly of the present invention employing triangular studs and J-runners and having a portion of a wall cut-away to show details of the embodiment.

The embodiment of shaft wall 101A of FIG. 6A is substantially the same as that of FIG. 6 but employs J-runners 10A, and 11A rather than C-runners. With reference to FIG. 6A, typically, a floor J-runner 10A and a ceiling J-runner 11A are installed in a substantially parallel relationship, with multiple triangular studs 112 positioned in a substantially perpendicular relationship between the floor J-runner 10A and the ceiling J-runner 11A.

The triangular stud 112 of the shaft wall is between the floor J-runner 10A and the ceiling J-runner 11A. The triangular stud 112 has a triangular polyhedron shape comprising three sidewalls defining a triangular bottom perimeter and a triangular top perimeter. Preferably, all transverse cross-sections of the triangular stud 112 parallel to the top perimeter and the bottom perimeter are the same triangle.

Each J-runner 10A, 11A has a horizontal middle wall (section) 6, a shorter first vertical wall 2A, and a taller second vertical wall 4A (FIG. 6). The middle wall 6 forms a substantially planar transverse plane having opposed first and second longitudinal sides each, having a length, and opposed first and second ends, each having a width, wherein the length of each longitudinal side is greater than the width of each end. The shorter first vertical wall 2A has a first height H1A and the taller second vertical wall 4A has a second height H2A, wherein the first height H1A is less than the second height H2A. The shorter first vertical wall 2A extends to the first height from the first longitudinal side of the middle wall 6. The taller second vertical wall 4A extends to the second height from the second longitudinal side of the middle section. The shorter first vertical wall 2 and the taller second vertical wall 4 are substantially parallel. The middle wall 6, the shorter first vertical wall 2 and the taller second vertical wall 4 form a generally J-shape.

Unlike the conventional system 1 of FIG. 2, the shaft wall assembly system 101A of the present invention has no shaft liner panel positioned between the floor J-runner 10A and the ceiling J-runner 11A, and between each of the studs 112. Points of the fasteners 35 end within a cavity within the triangular stud so they do not contact the inside space 28 of the shaft wall assembly 1 of the shaft wall assembly 101A. There is no need for shaft liner panels to separate the pointed inner ends of the fasteners from the inside space 28 of the shaft wall assembly.

Located outside the J-runners 10A and 11A are a pair of wall boards 14 and 15. When fully installed an inner surface of wall board 15 forms the inside of the shaft, while an outer surface of the wall board 14 forms the interior wall of a room.

Figure 7:
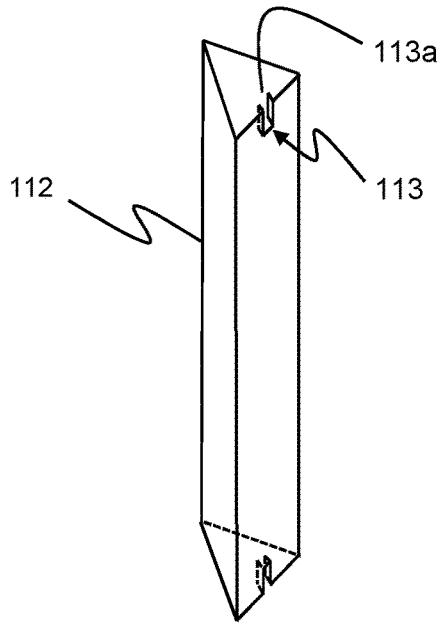
FIG. 7 is a top cross section of a triangular stud of the assembly of FIG. 6 having notches to assist placement.

FIG. 7 is a top cross section of the triangular stud 112 of the assembly 101 of FIG. 6 (and assembly 101 of FIG. 6A). The triangular stud 112 has notches 113 to assist placement. The notches 113 are formed by cutting and bending back wings 113*a* (FIG. 8) of metal of the triangular stud at an upper end and lower end of the triangular stud. The triangular stud 112 has a hollow interior.

Figure 8:
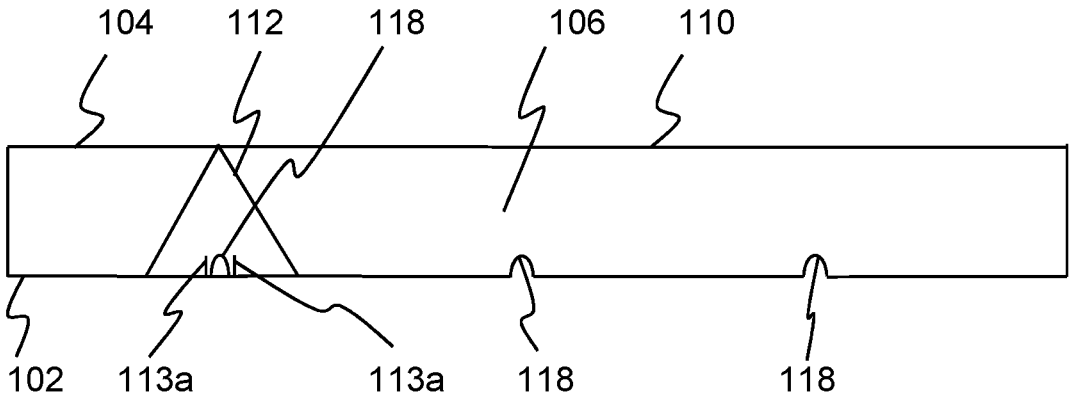
FIG. 8 is a top view of a J-runner of the invention having indentations on its lower wall to assist in placing the triangular stud of FIG. 7 in the assembly of FIG. 6.

FIG. 8 is a top view of the triangular stud 112 of FIG. 7 placed on a C-runner 110 of the invention. C-runner 110 has a first vertical wall 102, a second vertical wall 104, and a horizontal middle wall 106. J-runner 110 is modified to have indentations 118 on its shorter vertical wall to assist in placing the triangular stud 112 of FIG. 7 in a shaft wall assembly such as that of FIG. 6 or FIG. 6A. The indentations 118 mate with the notches 113. Preferably the indentations are 6 to 12 inches apart on center (OC), typically 8 inches apart OC.

Figure 9:
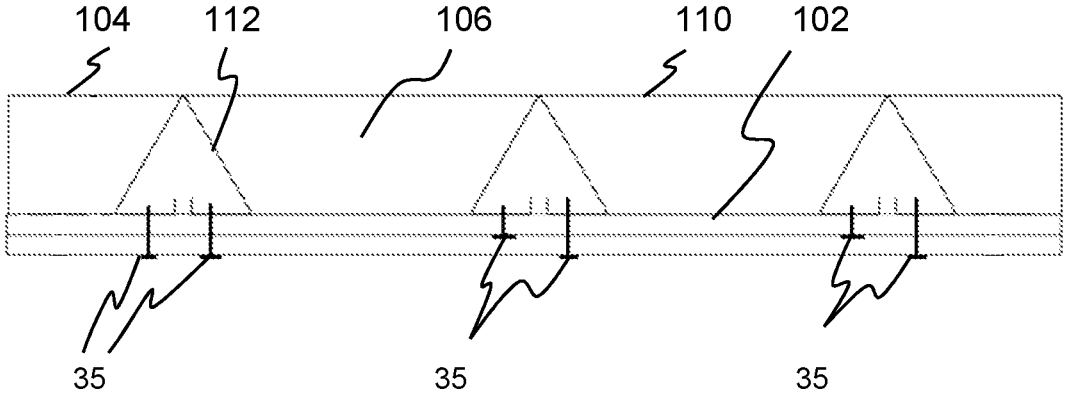
FIG. 9 illustrates a top view of a portion of the assembly of FIG. 6, including the lower J-runner of FIG. 8 and including the panels attached by fasteners to the triangular studs of the invention, however, the indentations of the J-runner of FIG. 8 are omitted in the drawing for clarity.

FIG. 9 illustrates a top view of a portion of the assembly 101 of FIG. 6, modified to include the floor runner 110 of FIG. 8 and the wall boards 14, 15 attached by fasteners 35 to the triangular studs 112 of the invention. However, the indentations of the floor runner 110 of FIG. 8 are omitted in FIG. 9 for clarity.

FIG. 10 shows a top view of an alternative embodiment of a triangular stud 142 of the invention without the notches, but having an overlapping corner forming a seam or punch connection 144. A seam is when two pieces of steel are basically rolled over to connect them. A punch connection would punch out a small section of steel creating a tab that will connect the two pieces of steel.

FIG. 11 shows a perspective view of the triangular stud 142 of FIG. 10 having the overlapping corner forming the seam or punch connection 144 and a hollow interior.

FIG. 12 is a top view of a C-runner 150 of the invention. C-runner 150 has a first vertical wall 152, a second vertical wall 154, and a horizontal middle wall 156. C-runner 150 is modified to have protrusions 158 on its second wall 154 to assist in placing the triangular stud 142 of FIG. 11 in a modified version of the assembly of FIG. 6. If desired the invention can employ a J-runner (not shown) modified to likewise have protrusions 158 on its higher wall 154 to assist in placing the triangular stud 142 of FIG. 11 in a modified version of the assembly of FIG. 6A.

Figure 13:
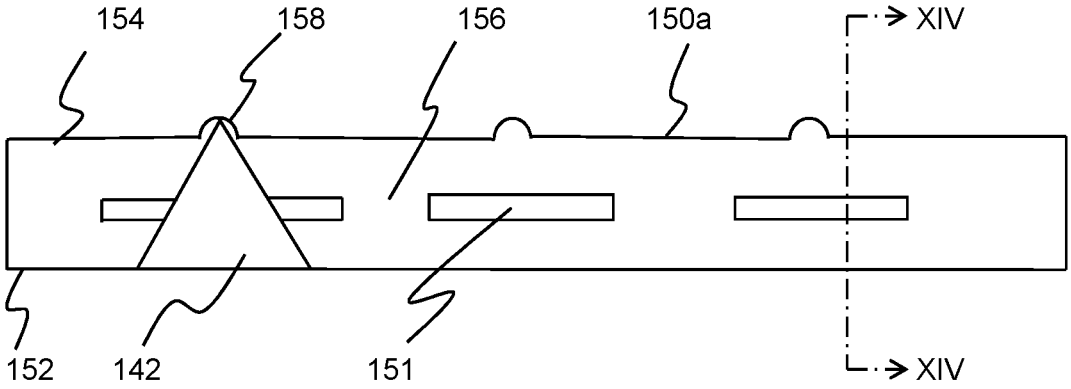
FIG. 13 is a top view of the embodiment of FIG. 12 modified to have a J-runner of the invention having protrusions on its higher wall to assist in placing the triangular stud of FIG. 11 in a version of the assembly of FIG. 6 employing a J-runner further modified to include stand-offs as lifting elements for drainage and to assist in placement of the triangular studs.

FIG. 13 is a top view of the embodiment of FIG. 12 further modified to include C-runner 150*a* having stand-offs 151 as lifting elements for drainage and to assist in placement of the triangular studs 142. The lifting elements 151 allow for self-centering of the triangular studs 142 between the C-runners. Preferably only the floor C-runner 150*a* is provided with lifting elements 151. However, if desired both upper and lower C-runners may be provided with lifting elements 151. The triangular wall stud 142 lines up with a respective lifting element 151. If the wall stud 142 rests on the lifting element 151, then the wall stud 142 will be centered. These lifting elements 151 are preferably constructed to allow for self-centering of the studs 142 in a vertical direction during installation and when assembled. Self-centering means the studs 142 are spaced above the middle wall 156 of the floor C-runner 150*a*. If desired the invention can employ a J-runner (not shown) modified likewise in a modified version of the assembly of FIG. 6A.

A first end of the lifting element 151 is proximal to the shorter vertical wall 152 and a second end of the lifting element 151 is distal to the shorter vertical wall 152. At least one triangular stud 142 is positioned on the lifting element 159. Also, preferably the lifting element 151 defines a drain in the horizontal middle wall 156 below the lifting element 151.

Figure 14:
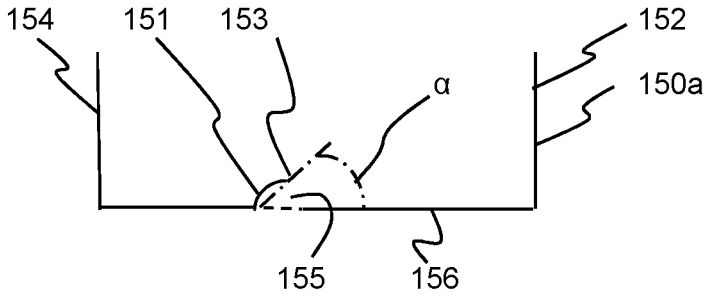
FIG. 14 is a side-view cross-section along view XIV-XIV of FIG. 13 including the lifting elements for drainage and to assist in placement of the triangular studs.

FIG. 14 is a side-view cross-section of the C-runner 150*a* of FIG. 13 along view XIV-XIV of FIG. 13 including the lifting elements 151 for drainage and to assist in placement. This shows a ramping edge 153 of the lifting element 151 can define an angle "a" of between 25° and 75°, preferably about 64° with respect to a y-axis parallel to the second upstanding section 154. The lifting element 151 can have a curved profile as shown in FIG. 14 or form a substantially transverse, top shelf (not shown). The lifting element 151 can have a total length K of about 3 to 12 inches. The lifting element 151 can have a height at its open mouth 155 of about 0.5 to 1 inch.

Figure 15:
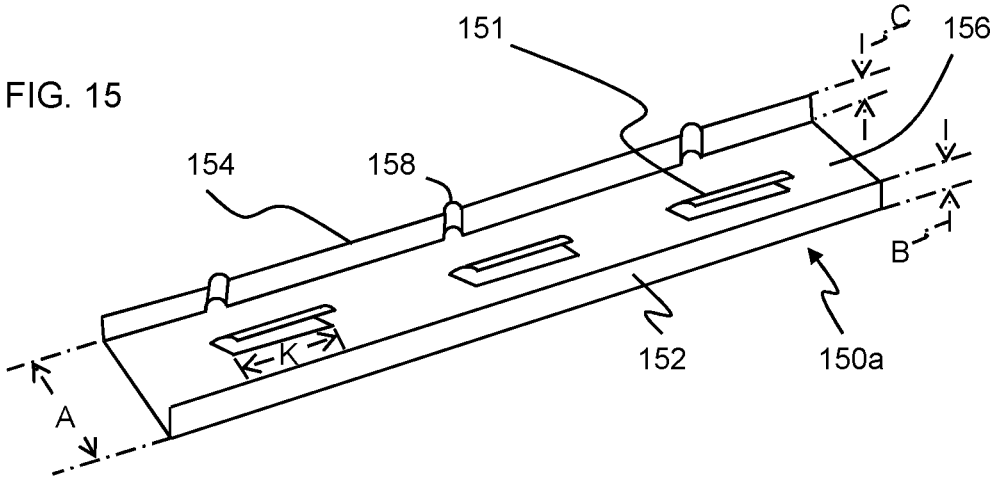
FIG. 15 is a perspective-view of the embodiment of FIG. 13 including tabs as the lifting elements for drainage and to assist in placement of the triangular studs.

FIG. 15 is a perspective-view of the J-runner 150*a* of FIG. 13 including the lifting elements 151 for drainage and to assist in placement.

Figure 16:
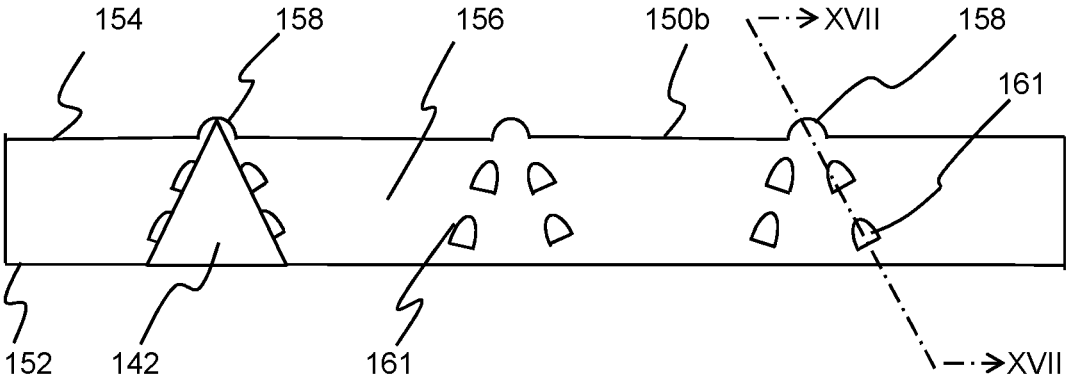
FIG. 16 is a top view of the embodiment of FIG. 12 modified to have a J-runner of the invention having protrusions on its higher wall to assist in placing the triangular stud of FIG. 11 in a version of the assembly of FIG. 6 employing a J-runner further modified to include tabs as lifting elements for drainage and to prop up the triangular studs.

FIG. 16 is a top view of the embodiment of FIG. 12 further modified to include C-runner 150*b* having tabs 161 as a lifting elements for drainage and to assist in placement of the triangular studs 142. The lifting elements 161 allow for self-centering of the triangular studs 142 between the C-runners. Preferably only the floor C-runner 150*a* is provided with the tabs 161 as lifting elements. However, if desired both floor and ceiling C-runners may be provided with the tabs 161. The triangular stud 142 lines up with respective lifting elements 161. If the wall stud 142 rests on the tabs 161, then the wall stud 142 will be centered. These tabs 161 are preferably constructed to allow for self-centering of the studs 142 in a vertical direction during installation and when assembled. Self-centering means the studs 142 are spaced above the middle wall 156 of the floor C-runner 150*b*.

Figure 17:
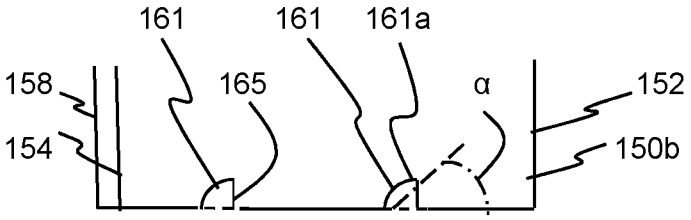
FIG. 17 is a side-view cross-section along view XVII-XVII of FIG. 16 including tabs as lifting elements for drainage and to assist in placement of the triangular studs.

FIG. 17 is a side-view cross-section of the C-runner 150*b* of FIG. 16 along view XVII-XVII of FIG. 16 including the tabs 161 as lifting elements for drainage and to assist in placement of the triangular wall studs. This shows a ramping edge 163 of the lifting element 161 can define an angle "a" of between 25° and 75°, preferably about 64° with respect to a y-axis parallel to the second upstanding section 154. The lifting element 161 can have a curved profile as shown in FIG. 17 or form a substantially transverse, shelf (not shown). The lifting element 161 can have a height from horizontal middle wall 156 to the highest point of its open mouth 165 of about 0.5 to 1 inch and a width at its open mouth 165 along horizontal middle wall 156 of about 0.5 to 1 inch.

Figure 18:
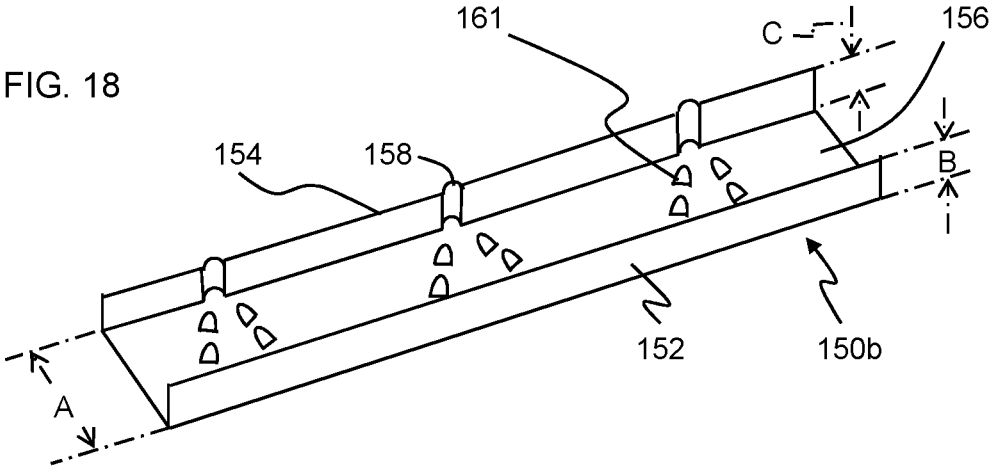
FIG. 18 is a perspective-view of the embodiment of FIG. 16 including the tabs as lifting elements for drainage and to assist in placement of the triangular studs.

FIG. 18 is a perspective-view of the C-runner 150*b* of FIG. 17 including the tabs 161 as lifting elements for drainage and to assist in placement.

FIG. 19 shows a top view of another alternative embodiment of the triangular stud 162 without the notches, but having a symmetrically overlapping corner forming a seam or punch connection 164.

FIG. 20 shows a top view of another alternative embodiment of the triangular stud 172 without the notches, but having a side including a symmetrically overlapping section forming a seam or punch connection 174.

FIG. 21 shows a top view of the embodiment of FIG. 13 further including blocking 180 applied to the face of the studs to add structural stability. If the wall boards 14, 15 are horizontal then one screw 35 may be sufficient as shown in the center stud 142, but when the panels are vertical two screws are employed as shown in the left and right triangular studs 142.

FIG. 22 shows a perspective view of the blocking 180 of FIG. 21. The blocking 180 has a center wall 186 and upright walls 184 defining a series of gaps 188 for engaging respective triangular studs 142.

Figure 23:
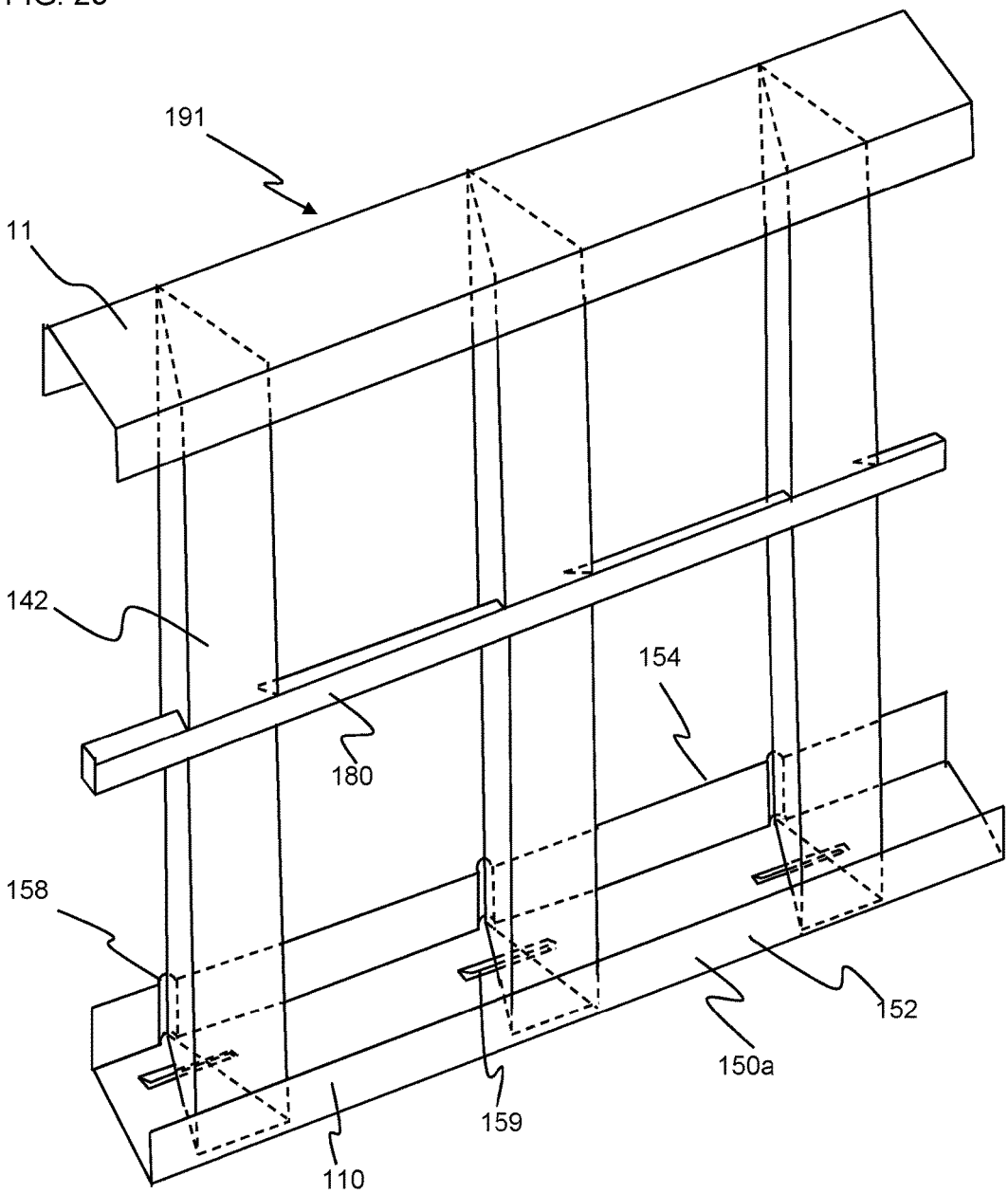
FIG. 23 is a perspective view of an embodiment of a shaft wall assembly of the invention employing triangular studs and the blocking of FIG. 21.

FIG. 23 is a perspective view of an embodiment 191 of a shaft wall assembly of the invention employing floor C-runner 150*a*, ceiling C-runner triangular studs 142, and the blocking 180 of FIG. 21.

The studs 12 can take the form of any stud having a triangular cross section suitable for placing in the present C-runner or J-runner. Typical materials for the studs include steel.

For beginning or terminating a wall, typically a metal framing member with a C or L profile is used.

The C-runners, J-runners, and the triangular studs of the invention can be formed of any suitable material. Typical materials include steel, for example 24 gauge (0.024 in, 0.6 cm) or 20 gauge (0.035 in, 0.9 cm) or other suitable gauges. The C-runners and J-runners and triangular studs can be formed by stamping or roll forming. To form the lifting elements, e.g. lifting element 151 or protrusions 158 of a runner, the runner can be lanced, stamped, pierced or notched.

C-runners and J-runners employed in the present invention including a bottom (middle) section 71, a shorter wall 69, and lifting elements 129. With reference to FIG. 15, C-runner 150*a* typically has a total width "A" of from about 2 to 6 inches (5.1 to 15.2 cm), typically either 2.5 or 4.0 inches (6.4 or 10.2 cm), between its first upstanding wall 152 and its second upstanding wall 154. The first and second upstanding walls typically have a height "B" of from about 0.75 to 2.0 inches (1.9 to 5.1 cm), preferably approximately 1 inch (2.54 cm).

J-runners are the same except the shorter upstanding wall typically has a height of from about 0.75 to 2.0 inches (1.9 to 5.1 cm), preferably approximately 1 inch (2.54 cm), while the taller upstanding wall typically has a height of from about 1.5 to 4 inches (3.8 to 10.2 cm), preferably about 2.0 to 2.5 inches (5.1 to 6.4 cm), more preferably about 2.1 inches (5.3 cm).

Although FIG. 20 shows an installation with a floor C-runner 110 of the invention, i.e., with lifting elements 159, and the ceiling C-runner 11 without any lifting elements, it is considered within the scope of the invention to utilize two same C-runners of the invention, e.g., two C-runners 110, i.e., one above the triangular studs 142 and one below the triangular studs 142. Likewise, it is considered within the scope of the invention to utilize a first J-runner of one embodiment of the invention in combination with a C-runner of another embodiment of the invention. Likewise it is within the scope of the invention to substitute the different embodiments of triangular studs for each other. Likewise, a similarly modified J-runner may be employed for both the floor runner and ceiling runner.

The invention has many advantages. It employs one or more, preferably two or more, most preferably 2 or 3, layers of wall board attached to one side of the triangular studs. The studs are triangular so the pointed end of the screw goes into the stud and is not exposed. Thus, the shaft wall of the invention does not need an inner liner panel wall as do shaft walls made with C-H studs. All the wall boards of the present shaft wall assembly are actually attached to studs rather than having some attached and others slidingly held by a runner and C-H studs.

Generally in assembling the shaft wall assembly the triangular studs are not attached to the top or bottom J-runner. Thus, to assist in placing the triangular stud, preferably the triangular stud has the notch described above for mating with an indentation on the inner shorter wall of the J-runner. Another preferred enhancement to assist in placing the triangular stud is for the J-runner to have the above-described protrusions along its outer taller wall to form cavities in which to locate an edge of the triangular stud.

Triangular studs are stronger than C-H studs for a given composition and gage of metal from which they are made. Thus, the shaft wall assemblies of the present invention can be made taller than shaft wall assemblies made with C-H studs.

CAD EXAMPLES

A Computer Assisted Design (CAD) simulation was run to compare a conventional 20 Gauge C-Stud with a 25 Gauge Triangle Studs of the present invention. The 25 Gauge Triangle Studs of the present invention was notched as shown by FIG. 7 and had the cross-section configuration shown in FIG. 10.

TABLE 1 shows mechanical properties achieved out of the CAD computer simulations. This data shows the 25 Gauge triangular stud at 3⅝" was equivalent to a 20 Gauge C-Stud at 3⅝" deep.

TABLE 1

| Parameter | Triangular Shaped Stud (Mass Properties CAD of FIG. 10 triangular stud) | Conventional C Studs (SSMA 2015 IBC)* |
|---|---|---|
| Area (A) ($in^2$) | 0.242 | 0.194 |
| Moment Of Inertia (MOI X) ($in^4$) | 0.709 | 0.381 |
| Moment Of Inertia (MOI Y) ($in^4$) | 1.468 | 0.033 |
| Effective Section Modulus (S X) ($in^3$) | 0.3484 | 0.156 |
| Gauge | 25 gauge (0.0188 in.) | 20 gauge (0.0312 in.) |
| Depth (in.) | 3⅝ in. | 3⅝ in. |
| Width (in.) | 4 3/16 in. | 1¼ in. |

*Steel Stud Manufacturer's Association 2015 International Building Code

The CAD simulation showed the triangular stud configuration has multiple advantages. It has greater moment of inertia about strong "X" access allowing for increase in limiting heights. It also has much greater weak moment of inertia about "Y" access allowing for greater unbraced lengths, especially in instances where wallboard sheathing is only on one side. The stud allows easy of installation in case of a vertical board joint since there is more space for two rows of fasteners.

It should be apparent that embodiments other than those specifically described above may come within the spirit and scope of the present invention. Hence, the present invention is not limited by the above description.

We claim:

1. A shaft-wall assembly comprising:

a shaft wall having upper, lower, left and right sides;

a first runner positioned adjacent to the lower side of the shaft wall, a second runner, positioned adjacent to the upper side of the shaft wall, wherein each of the first runner and the second runner comprises:

a substantially planar transverse middle section having opposed first and second longitudinal sides each having a length and opposed first and second ends each having a width, wherein the length of each longitudinal side is greater than the width of each end;

a first upstanding section and a second upstanding section, wherein the first upstanding section has a first height and the second upstanding section has a second height, the first upstanding section extending to the first height from the first longitudinal side of the middle section, and the second upstanding section extending to the second height from the second longitudinal side of the middle section, wherein the first upstanding section and the second upstanding section are substantially parallel;

a triangular stud of the shaft wall between the first runner and the second runner, the triangular stud having a triangular polyhedron shape comprising three sidewalls defining a triangular bottom perimeter and a triangular top perimeter;

the first runner and the triangular stud sized for a first said side of the triangular stud to contact the first upstanding section of the first runner and a vertex of the triangular stud opposed to the first side of the triangular stud to contact the second upstanding section of the first runner.

2. The assembly of claim 1, further comprising a panel attached to said first side of the triangular stud and contacting at least one member of the group consisting of the first runner and the second runner.

3. The assembly of claim 2, wherein the panel is attached to the triangular stud by screws, wherein the triangular stud is made of steel and the first and second runners are made of steel.

4. The assembly of claim 1, wherein all transverse cross-sections of the triangular stud parallel to the top perimeter and the bottom perimeter are the same triangle.

5. The assembly of claim 1, wherein the first upstanding section of the first runner has at least one indentation, and a lower portion of a said side of the triangular stud has a notch for mating with the indentation.

6. The assembly of claim 1, wherein the first upstanding section of the second runner has at least one indentation, and an upper portion of a said side of the triangular stud has a notch for mating with the indentation.

7. The assembly of claim 1, wherein the first upstanding section of the first runner has at least one indentation, and a lower portion of a said side of the triangular stud has a notch for mating with the indentation, and wherein the first upstanding section of the second runner has at least one indentation, and an upper portion of a said side of the triangular stud has a notch for mating with the indentation.

8. The assembly of claim 1, wherein the second upstanding section of the first lower runner has at least one respective outwardly directed protrusion and the first triangular stud has a lower perimeter sized to extend from the first upstanding section to the second upstanding section such that a lower corner of the first triangular stud lower perimeter mates with the respective protrusion of the first lower runner and the second triangular stud has a lower perimeter sized to extend from the first upstanding section to the second upstanding section.

9. The assembly of claim 1, wherein the second upstanding section of the first runner and the second runner each have at least one respective outwardly directed protrusion and the first triangular stud has a lower perimeter sized to extend from the first upstanding section to the second upstanding section such that a lower corner of the triangular stud lower perimeter mates with the respective protrusion of the first runner and the triangular stud has a lower perimeter sized to extend from the first upstanding section to the second upstanding section such that an upper corner of the triangular stud upper perimeter mates with the respective protrusion of the second runner.

10. The assembly of claim 1, wherein the second upstanding section of the second runner has at least one outwardly directed protrusion and the triangular stud has an upper perimeter sized to extend from the first upstanding section to the second upstanding section such that a corner of the triangular stud upper perimeter mates with the protrusion.

11. The assembly of claim 1, wherein the first runner comprises at least one lifting element disposed on the middle section, wherein the at least one lifting element disposed on the middle section comprises a first ramping edge, the first ramping edge having a first end connected to the middle section of the first runner, and having a second end disposed from the middle section to be between the first upstanding section and the second upstanding section, wherein the first ramping edge of the lifting element is disposed at an angle $\alpha$, and $\alpha$ is less than 90° with respect to the middle section, the first end of the at least one lifting element being proximal to the first upstanding section and the second end of the at least one lifting element being distal to the first upstanding section, wherein at least one said triangular stud is positioned on the lifting element, wherein the lifting element defines a drain in the middle section below the lifting element.

12. The assembly of claim 1, further comprising a first panel having opposed first and second planar sides, the first panel first planar side contacting the triangular stud and the first upstanding section of the first runner, the first panel second planar side distal to the triangular stud, a second panel having opposed first and second planar sides, the second panel first planar side proximal to the first triangular stud, the second panel second planar side distal to the first triangular stud, the second panel applied over the second planar side of the first panel so the second panel first planar side contacts the first panel second planar side, the first and second panels attached to the first side of the triangular stud.

13. The assembly of claim 12, the first panel and second panel are attached to the first side of the triangular stud by screws, wherein the triangular stud is are made of steel and the first and second runners are made of steel.

14. The assembly of claim 1, further comprising a second triangular stud and blocking the blocking extending from the first triangular stud to the second triangular stud, the blocking having a rectangular base wall having two opposed longitudinal sides, a first sidewall extending from one longitudinal side and a second sidewall extending from the other longitudinal side, the first sidewalls having notches, the second sidewall having notches, each notch of the first sidewall aligned with a respective notch of the second sidewall such that a said notch of the first sidewall and a respectively aligned said notch of the second sidewall engage a respective said triangular stud.

* * * * *